United States Patent [19]

Krimsky

[11] Patent Number: 4,889,072

[45] Date of Patent: Dec. 26, 1989

[54] COATING APPARATUS

[75] Inventor: Leonard C. Krimsky, Englewood, N.J.

[73] Assignee: Worldwide Converting Machinery, Allendale, N.Y.

[21] Appl. No.: 339,641

[22] Filed: Apr. 18, 1989

[51] Int. Cl.[4] ..... B05C 1/00

[52] U.S. Cl. ..... 118/244; 118/249; 118/259; 118/410; 118/419; 425/113

[58] Field of Search ..... 427/356; 118/205, 206, 118/258, 259, 244, 249, 405, 407, 410, 413, 419, 209, 224, 261; 425/113

[56] References Cited

U.S. PATENT DOCUMENTS

| | | | |
|---|---|---|---|
| 2,252,204 | 8/1941 | Reilly | 118/249 |
| 3,989,005 | 11/1976 | Bowler et al. | 118/261 |
| 4,250,211 | 2/1981 | Damrau et al. | 427/356 |
| 4,259,949 | 7/1981 | Esser | 427/356 |

*Primary Examiner*—Willard Hoag

*Attorney, Agent, or Firm*—Shenier & O'Connor

[57] ABSTRACT

Apparatus for applying a thin coating to a web in which the outer end of a die assembly is moved into interfering relationship with the outer elastomeric position of a backing roll so that coating material supplied to said die assembly pocket of coating material covering a discharge orifice in the outer end of the die assembly.

20 Claims, 5 Drawing Sheets

COATING APPARATUS

FIELD OF THE INVENTION

The invention relates to coating apparatus and more particularly to an improved coating apparatus for applying a thin coating to a web or film.

BACKGROUND OF THE INVENTION

There are many instances in the prior art in which a coating must be applied to a continuously moving web or film. In the prior art coatings solutions generally include a solvent which facilitates the application of the coating to the web.

One of the problems which exists in coating systems of the prior art is pollution resulting from the evaporation of the solvent after the coating has been applied. Very expensive installations such as an incinerator or solvent recovery systems are required in order to obviate the harmful effects of such pollution.

In order to overcome the problem desccribed above, it has been suggested that water be substituted for the solvents normally employed. Application of such a material, however, is still difficult owing to the low viscosity of the material.

One modern coating system which has been proposed is one which uses no solvent but which is applied in liquid form and immediately cured. A system of this type is known as a 100% solids system. While such a system successfully avoids the problem of pollution, it is, as will be appreciated, extremely difficult to apply a thin coating since there is no evaporation. That is to say, where the material being applied includes a solvent which evaporates after application, a relatively thick coating can be applied to leave the desired thin coating when the solvent evaporates. However, where a 100% solids material is being applied, the initial coating of material must be very nearly the same thickness as the desired coating.

Various forms of coating apparatus are known in the prior art. Most of these systems include resilient lips or blades which are designed to control the thickness of the applied layer. Such apparatus has not been successfully employed to apply a thin coating in a 100% solids coating system.

SUMMARY OF THE INVENTION

One object of my invention is to provide a method of and apparatus for applying very thin coatings to a moving web or film of material.

Another object of my invention is to provide a method of and apparatus for applying coatings in a 100% solids system.

A further object of my invention is to provide a method of and apparatus for applying a very thin coating to a moving web or film having means for adjusting the coating thickness in a rapid and expeditious manner.

Other and further objects of my invention will appear from the following description.

BRIEF DESCRIPTION OF THE DRAWINGS

In the accompanying drawings to which reference is made in the instant specification and which is to be read in conjunction therewith and in which like reference numerals are used to indicate like parts in the various views.

DESCRIPTION OF THE PREFERRED EMBODIMENT

Figure 1:
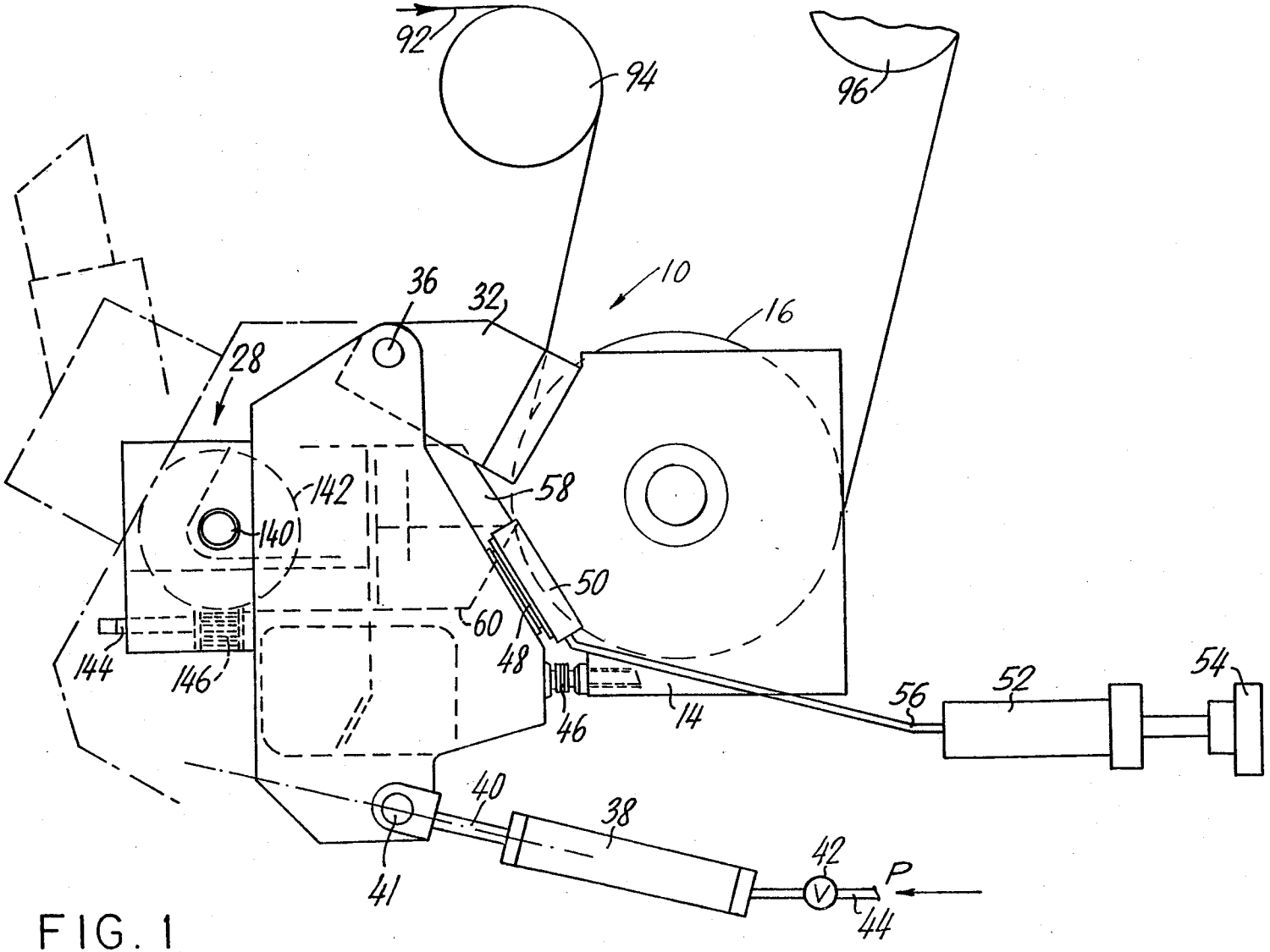
FIG. 1 is a side elevation of the general arrangement of my apparatus for applying a very thin coating to a moving web or film of material.
Figure 2:
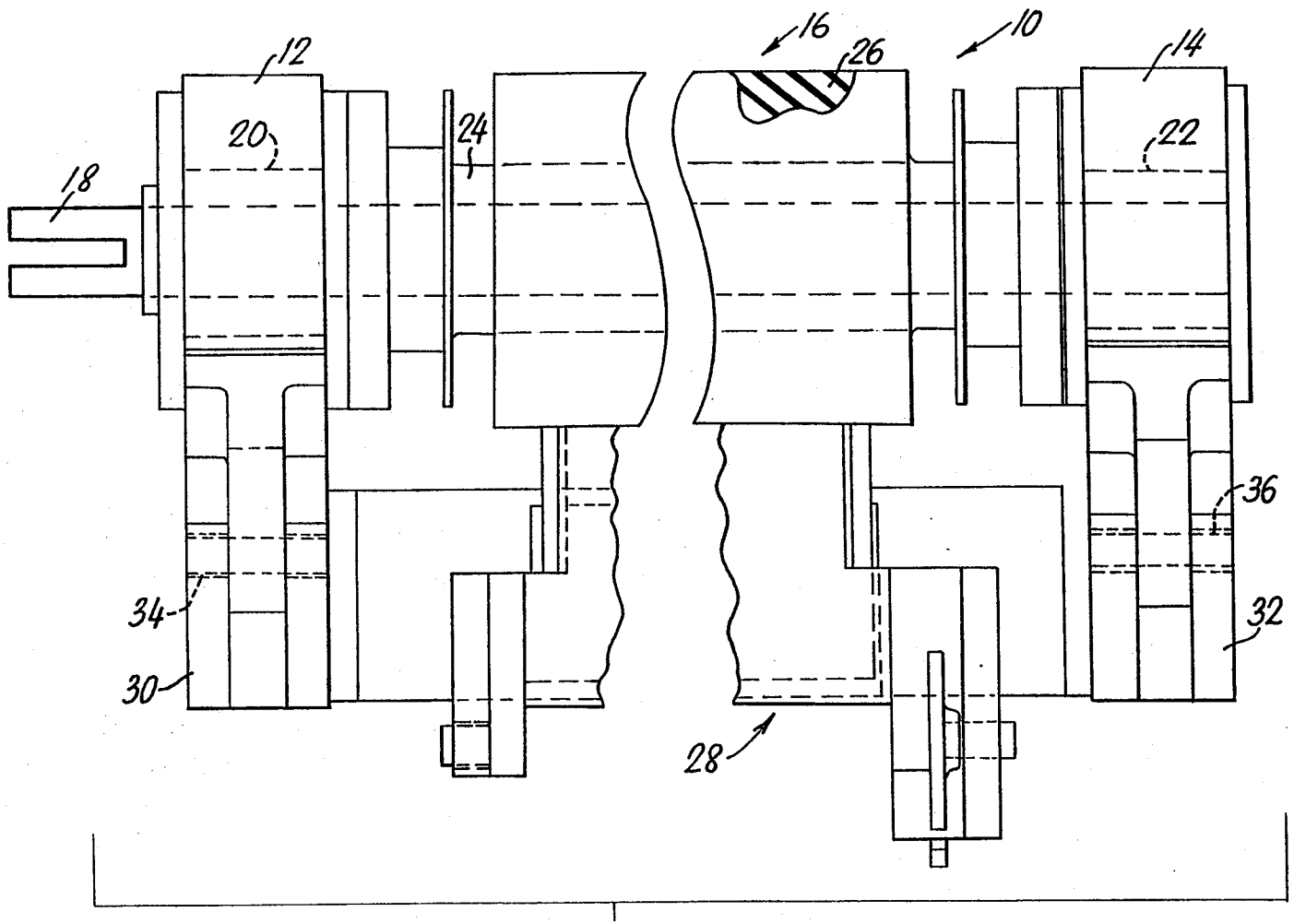
FIG. 2 is a top plan of the apparatus shown in FIG. 1.

Referring now to FIGS. 1 and 2, my coating apparatus indicated generally by the reference character 10 includes a left hand frame member 12 and a right hand frame member 14. The backing roller 16 of my coating apparatus is supported on a shaft 18 carried by bearings 20 and 22 in the frame members 12 and 14. As will be explained more fully hereinbelow, the backing roller 16 includes a core 24 of metal and a covering 26 of elastomeric material.

Preferably the material of which the cover is formed has a hardness of between 30 and 80 on the Shore A scale. My coating apparatus includes a die assembly indicated generally by the reference character 28 pivotally mounted on left-hand and right-hand supports 30 and 32 on the frame members 12 and 14 by means of pins 34 and 36.

A pneumatic cylinder 38 having a piston rod 40 connected to a pin 41 to the die assembly 28 is adapted to be supplied with air under pressure from a pipe 44 under the control of a valve 42. The air under pressure supplied to the cylinder 38 moves the assembly 28 toward and away from one or more adjustable stops 46 on the machine frame.

My apparatus includes a gap adjusting piston and cylinder arrangement including a piston 48 carried by the assembly 28 and a cylinder 50 secured to the support 40, for example. Oil is adapted to be displaced from a reservoir 52 through a pipe 56 leading to the inside of cylinder 50 in response to operation of a handle 54. The amount of oil fed to the cylinder 50 determines the position of the die assembly 28 relative to the roll 16. It will readily be appreciated that the oil pressure within cylinder 50 and the pneumatic pressure within the cylinder 38 act against each other in properly positioning the die assembly relative to the roll in a manner to be described.

Figure 3:
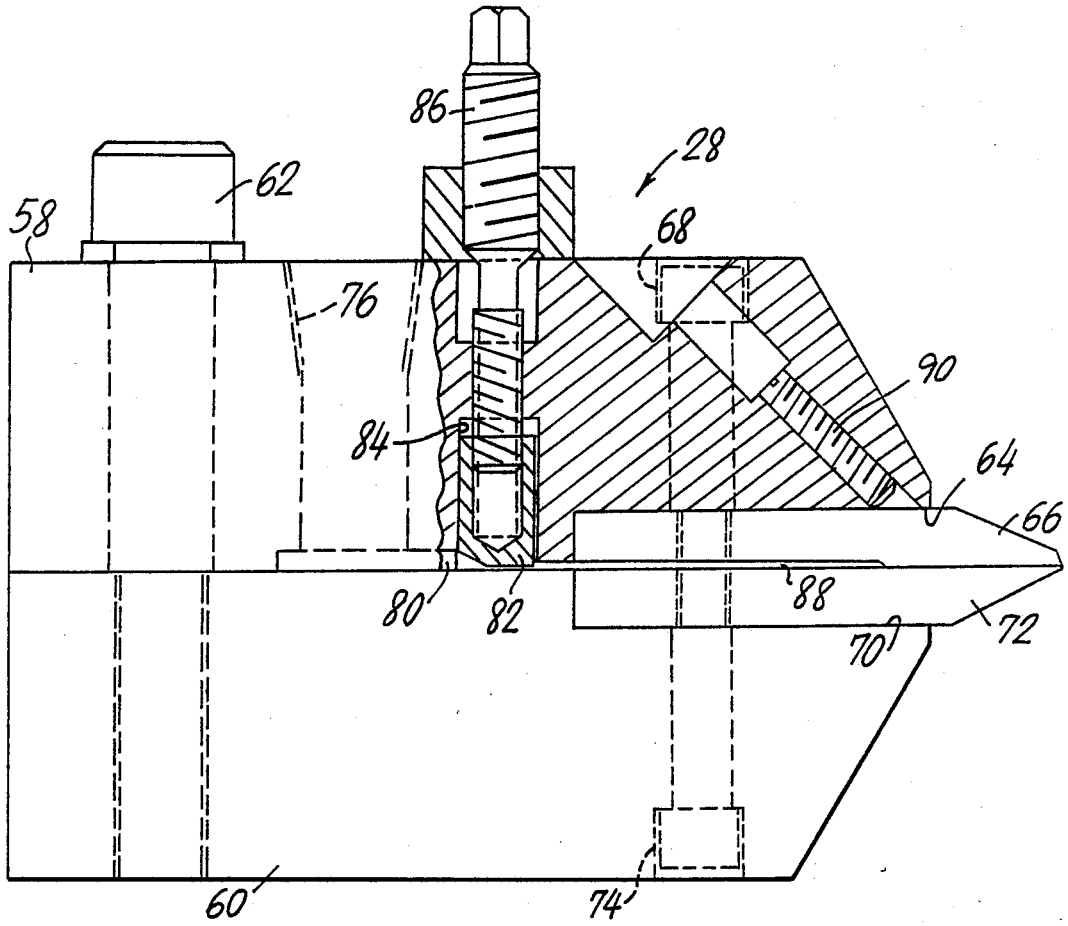
FIG. 3 is an end elevation of the die assembly of my coating apparatus.
Figure 4:
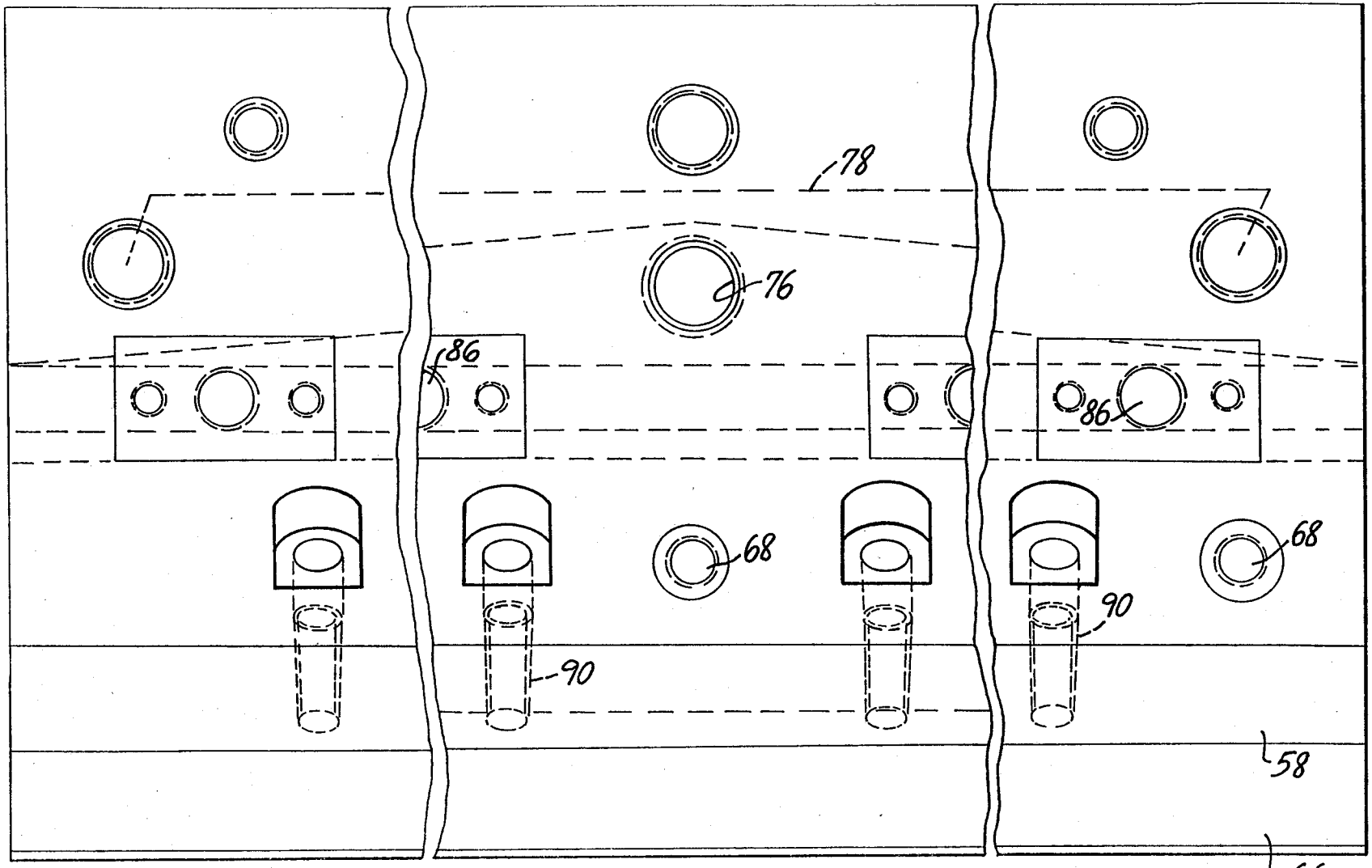
FIG. 4 is a top plan of the die assembly shown in FIG. 3.

Referring now to FIGS. 3 and 4, the die assembly 28 includes an upper jaw 58 and a lower jaw 60 which may be clamped together by means of screws 62. I form the upper jaw 58 with a recess 64 adapted to receive the upper lip 66 of the assembly. Screws 68 or the like may be employed to hold the lip 66 in the recess 64. I provide the lower jaw 60 with a recess 70 for receiving the lower lip 72 which may be held in place in the recess by means of screws 74 or the like.

I provide the upper jaw 58 with a plurality of threaded inlet openings 76 for the introduction of the coating solution. The solution may, for example, be fed to a manifold 78, indicated schematically by the broken line in FIG. 4, which supplies the respective inlets 76 to introduce the coating solution into a passage 80 formed by the upper and lower jaws and extending generally along the entire length of the assembly 28.

I mount a choker bar 82 in an elongated slot 84 in the upper jaw 58. A plurality of differential screws 86 spaced along the length of the assembly 28 can be operated to adjust the position of the bar 82 in the slot 84 at locations along the length of the assembly 28 to control the flow from the passage 80 to a channel 88 formed by the upper and lower lips 66 and 68. Choker bar 82 builds up a back pressure on low viscosity coatings to cause the coating to flow uniformly across the machine width. It will be appreciated that for a wide machine the coating tends to channel itself through the center. By use of the choker bar, the opening between the passage 80 and the channel 88 can be contoured so as to be a little narrower in the center and opened up somewhat in the ends to provide a uniform flow.

I provide the upper jaw 58 with a plurality of set screws 90 in engagement with the upper lip 66. These set screws 90 can be turned to deflect the upper lip in such a way as to ensure a uniform flow of fluid from channel 88 outwardly between the two lips 66 and 72.

Referring again to FIGS. 1 and 2, the web or film 92 to be coated extends over a guide roll 94 to the space between the die assembly 28 and the roll 16 and then upwardly to an exit roll 96. As is well known in the art, the web 92 is driven by any suitable means so as to move in the direction of the arrow in FIG. 1.

Figure 5:
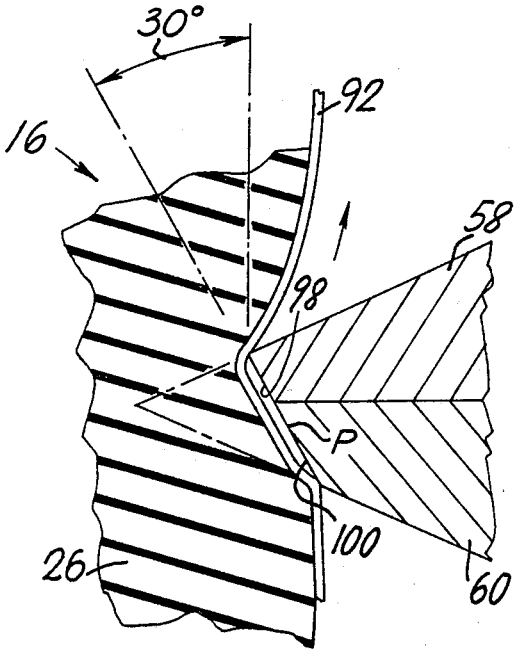
FIG. 5 is a fragmentary sectional view of a portion of my apparatus illustrating the manner in which the coating is applied to the web or film.

Referring now to FIG. 5, I form the outer end of upper lip 58 with a beveled surface 98. Similarly, I form the outer end of the lower lip 60 with a beveled surface 100 which is in registration with the surface 98. Preferably, the plane of the two surfaces 98 and 100 forms an angle of approximately 30° with a perpendicular to the line along which the upper and lower lips meet. My arrangement is such, moreover, that when the die assembly 28 is brought into operative reltionship with the roll 16, the outer ends of the lips bite into the rubber cover 26, or the web or film 92 extending over the cover 26, at the point of contact such that all the surfaces 98 and 100 engage either the web 92 on the cover 26 or the cover 26 directly. Under this condition, when the coating operation takes place the coating which is fed by the lips forms a closed pocket P extending along the length of the assembly. Measured along a line from the end of the die lips toward the center of the roll 16, the pocket P may have a depth in the region of 1/64th or even 1/128th of an inch between the lips and the surface of the web 92 or of the covering 26 when the coating is being applied directly to the roll. It is to be undstood that the angle of 30° between the plane of the beveled rs 98 and 100 and the perpendicular to the line along which the lips meet is not critical. If the angle is too great, e web2 or the covering 26 may be torn. Preferably, the angle is between around 45° and 15°.

Figure 7:
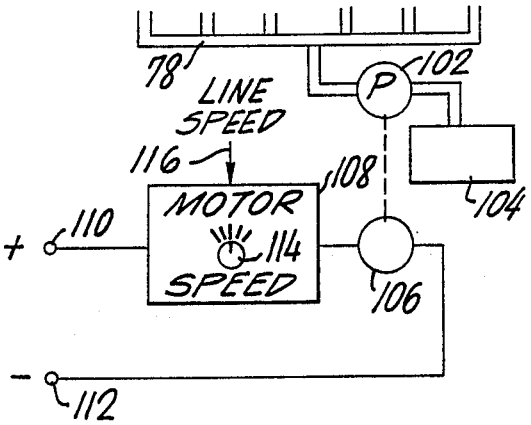
FIG. 7 is a schematic view of one form of control circuit which I may employ with my coating apparatus.

Referring now to FIG. 7, the coating from a reservoir 104 is adapted to be supplied by a pump 102 to the manifold 78. A DC motor 106 is adapted to be energized to drive pump 102. I connect motor 106 and a motor speed controller 108 to the terminals 110 and 112 of a suitable source of DC potential. Motor control 108 has a manual speed control input 114 and a line speed input 116. It will readily be appreciated that the line speed signal can be derived from a tachometer or any other suitable means which generates a signal representative of the speed of movement of the web 92.

Figure 6:
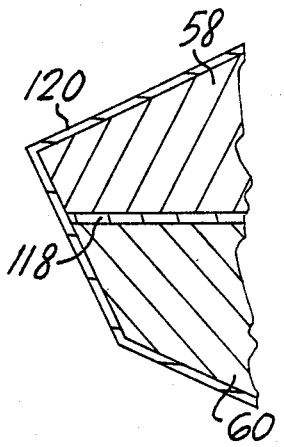
FIG. 6 is a fragmentary end elevation illustrating one edge deckle arrangement which I may employ on my coating apparatus.

Referring now to FIG. 6, I have shown one form of edge deckle arrangement which can be employed with my coating apparatus. In this arrangement shims 118 are disposed between the lips 58 and 60 at locations beyond the ends of the web being coated. In addition, any suitable means such as a strap 120 applied to the lips beyond the ends of the web to prevent the outflow of coating at the ends of the pocket P.

Figure 8:
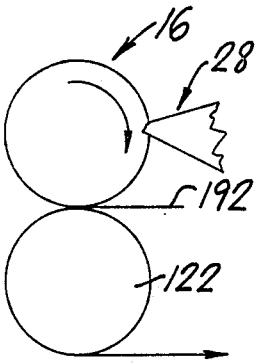
FIG. 8 is a schematic view of an alternate embodiment of my apparatus for applying a very thin coating to a moving web or film.

In some instances, coatings must be applied to films which have such smooth surfaces as compared to paper that when an attempt is made to apply the coating directly thereto by means of the die assembly, the coating just wipes right off and the film comes out perfectly clean. In such a situation, I have been able successfully to apply the coating directly to the roll 16 and then transfer it to the film. Referring now to FIG. 8, in such a system the die assembly 28 applies the coating directly to the roll 16. Roll 16, in turn, transfers the coating to the surface of the film 92 which is supported on a roller 122.

In the form of my invention shown in FIGS. 3 and 4, bolts are employed to hold the upper and lower jaws of the die together. In an alternative arrangement illustrated in FIGS. 1 and 2, with the assembly 28 in its inoperative position, a shaft 144 can be turned by means of a suitable tool (not shown) to rotate a worm 146 to drive a worm wheel 142 to move the upper jaw 58 away from the lower jaw 60 around a pivot shaft 140. This position of the parts is shown in dot-dash lines in FIG. 1.

In operation of my coating apparatus, I first actuate the air cylinder 38 to bring the assembly 28 into its operative position. Next, the handle 54 is operated to actuate the piston and cylinder assembly 48 and 50 to position the die assembly so that the tips of the lips 66 and 72 bite into the rubber covering 26 to the desired degree as illustrated in FIG. 5. With the parts in this position, motor 106 is energized to dry pump 102 to supply the coating to form the pocket P.

It will be appreciated that, as has been explained hereinabove, the pocket P is substantially closed so that no significant amount of coating material escapes. This makes my system suitable for both aqueous coatings and 100% solids coating. As to low viscosity coatings, I have been able successfully to coat down to 100 centipoise. The same fact makes our system eminently suitable for use with 100% solids coatings and particularly in applying extremely thin coatings thereof. Such coatings are in the liquid phase as they are applied but they dry extremely rapidly upon application, at least to a precured state.

I have further discovered that there is a substantially linear relationship between the speed of the pump motor 106 and the thickness of the coating applied. Thus, by the simple expedient of changing the motor speed I am able to change the thickness of the coating. In addition, where the motor speed control unit 108 has the line speed input 116, the coating system is automatically compensated for variations in line speed.

It will be seen that I have accomplished the objects of my invention. I have provided a method of and apparatus for applying a very thin coating to a web or film. My system is especially adapted for both aqueous coatings and 100% solids coatings. It substantially eliminates the problem of pollution caused by solvents used in systems of the prior art. My system incorporates an extremely simple and expeditious means for regulating the film coating.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for applying a thin coating to a web including in combination, a die assembly with an outer end having a discharge orifice for coating material, a backing roll having an outer portion of elastomeric material, means for positioning said die assembly and said backing roll in interfering relationship to cause said die assembly to deform said outer roll portion, and means for supplying coating material to said die to form a closed pocket of coating material covering said discharge orifice.

2. Apparatus as in claim 1 in which said discharge orifice is elongated in a direction transversely of said web.

3. Apparatus as in claim 1 in which said die assembly includes a pair of lips forming said discharge opening.

4. Apparatus as in claim 3 including edge deckles at the outboard ends of said lips.

5. Apparatus as in claim 4 in which said edge deckles comprise shims between said lips and straps over said lips at the outboard ends thereof.

6. Apparatus as in claim 1 in which said web passes between said die assembly and said backing roll so that said coating material is applied directly to said web by said die assembly.

7. Apparatus as in claim 1 including a second roll forming a nip with said backing roll, said web passing through said nip so that said die backing roll and said backing roll applies said coating material to said web at said nip.

8. Apparatus as in claim 1 in which said means for supplying coating material to said die assembly includes a supply of coating material, a pump for delivering coating material from said supply to said die assembly and means for controlling said pump to regulate the thickness of the coating applied to said web.

9. Apparatus as in claim 8 in which said controlling means comprise a motor for driving said pump and a motor speed control having a manual input and a line speed input.

10. Apparatus as in claim 1 in which said positioning means comprises means for moving said die assembly for movement between an inoperative position away from said backing roll and said interfering position.

11. Apparatus as in claim 1 in which said die assembly includes upper and lower jaws and means for moving said jaws between open and closed positions.

12. Apparatus as in claim 1 in which said die assembly comprises a pair of lips forming said discharge orifice, said lips being beveled at said outer end with reference to said channel.

13. Apparatus as in claim 12 in which said lips at said outer end are bevelled in a common plane.

14. Apparatus as in claim 13 in which said bevelled lips at said outer end form an outer edge and an inner edge and means for driving said backing roll to move the outer surface thereof in a direction from said inner edge toward said outer edge.

15. Apparatus for applying a thin coating to a traveling web including in combination, a die assembly comprising first and second jaws having respective lips elongated in a direction transverse to the direction of travel of said web, means for bringing said jaws together to form a discharge passage between said lips, said lips being beveled with reference to said passage to form a common plane at the end of said discharge passage, said plane forming an acute angle with a perpendicular to said passage such that one of said lips extends beyond the other, a backing roll having an outer portion of elastomeric material, means for positioning said die assembly lips and said backing roll in interfering relationship, means for supplying coating material to said passage to form a closed pocket of said coating material covering the end of said discharge passage, and means for rotating said roll in a direction to move the surface thereof in a direction from said other lip to said one lip.

16. Apparatus as in claim 15 in which said pocket covers the portions of said lips lying in said plane.

17. Apparatus as in claim 15 in which said positioning means comprises means for adjusting the position of said roll relative to said die assembly.

18. Apparatus as in claim 15 including means disposed along the length of one of said lips for contouring said lip to regulate the flow of coating material issuing from said discharge passage.

19. Apparatus as in claim 15 in which said means for supplying coating material to said passage comprises a choker bar.

20. Apparatus as in claim 15 in which said means for supplying coating material to said passage comprises a pump, a D.C. motor for driving said pump and means for controlling said motor to regulate the thickness of said coating.

* * * * *

UNITED STATES PATENT AND TRADEMARK OFFICE

CERTIFICATE OF CORRECTION

PATENT NO. : 4,889,072

DATED : December 26, 1989

INVENTOR(S) : Leonard C. Krimsky

It is certified that error appears in the above-identified patent and that said Letters Patent is hereby corrected as shown below:

In the Claims:

Col. 5, line 42, after "die" insert

--applies said coating material to said--;

Col. 6, line 2, change "moving" to --mounting--.

Signed and Sealed this

Sixth Day of November, 1990

*Attest:*

HARRY F. MANBECK, JR.

*Attesting Officer*

*Commissioner of Patents and Trademarks*